US007559145B2

(12) United States Patent
Jäcke et al.

(10) Patent No.: US 7,559,145 B2
(45) **Date of Patent: *Jul. 14, 2009**

(54) METHOD FOR PRODUCING A WHEEL DISC

(75) Inventors: Utz Jäcke, Santpedor (ES); Ramon J. Aquilué, Manresa (ES); Jordi Bosch, Manresa (ES)

(73) Assignee: Hayes Lemmerz International, Inc., Northville, MI (US)

( * ) Notice: Subject to any disclaimer, the term of this patent is extended or adjusted under 35 U.S.C. 154(b) by 250 days.

This patent is subject to a terminal disclaimer.

(21) Appl. No.: 11/345,530

(22) Filed: Feb. 1, 2006

(65) Prior Publication Data

US 2007/0175038 A1 Aug. 2, 2007

(51) Int. Cl.

| | |
|---|---|
| ***B21D 53/26*** | (2006.01) |
| ***B21D 22/00*** | (2006.01) |
| ***B23D 17/00*** | (2006.01) |
| ***B21K 1/38*** | (2006.01) |
| ***B21J 5/00*** | (2006.01) |
| ***B60B 3/10*** | (2006.01) |

(52) U.S. Cl. ..... 29/894.3; 29/894.323; 29/894.324; 29/894.325; 29/894.33; 29/894.353; 72/354.2; 72/353.2; 72/353.6; 301/64.101; 301/64.102

(58) Field of Classification Search ..... 29/894, 29/890.3, 894.3, 894.323, 894.324, 894.325, 29/894.33, 894.353; 72/354.2, 353.2, 353.6; 301/64.101, 64.102

See application file for complete search history.

(56) References Cited

U.S. PATENT DOCUMENTS 1,376,390 A 4/1921 Michelia
1,544,242 A 6/1925 Lavery
1,731,277 A * 10/1929 Smith ..... 29/894.325

(Continued)

FOREIGN PATENT DOCUMENTS

DE 1 605 544 3/1971

(Continued)

OTHER PUBLICATIONS

1998 Full Face Vehicle Wheel.

(Continued)

*Primary Examiner*—David P Bryant
*Assistant Examiner*—Alexander P Taousakis
(74) *Attorney, Agent, or Firm*—MacMillan, Sobanski & Todd, LLC

(57) ABSTRACT

A method of forming a wheel disc starts with a flat blank. A plurality of windows are formed in the wheel disc, wherein each window has a respective outer edge proximate with a continuous outer band around a periphery of the wheel disc. The windows define a plurality of spokes between adjacent windows, and the angular size of each of the windows along the outer band is preferably greater than the angular size of each of the spokes. The outer band is partially closed toward a cylindrical shape by engaging a cam die against at least a portion of the outer band. The outer band is substantially fully closed into a cylindrical shape by axially wiping the outer band using a cylindrical die. The intermediate camming operation achieves the desired final shape after wiping without introducing stresses that would weaken or distort the wheel disc.

9 Claims, 15 Drawing Sheets

U.S. PATENT DOCUMENTS

| | | | | | |
|---|---|---|---|---|---|
| 1,743,944 | A | | 1/1930 | Watrous | |
| 1,750,483 | A | | 3/1930 | Michelin | |
| 1,890,546 | A | | 12/1932 | Michelin | |
| 1,897,375 | A | | 2/1933 | Greenwald | |
| 2,143,457 | A | | 1/1939 | Sinclair | |
| 2,162,751 | A | | 6/1939 | Sauzedde | |
| 2,187,032 | A | | 1/1940 | Horn et al. | |
| 2,406,062 | A | * | 8/1946 | Cornell | 29/894.325 |
| 2,481,187 | A | | 9/1949 | Ash | |
| 3,298,218 | A | * | 1/1967 | Gollwitzer | 72/353.6 |
| 3,478,560 | A | * | 11/1969 | O'Brien | 72/257 |
| 3,623,774 | A | | 11/1971 | Funke et al. | |
| 3,729,795 | A | * | 5/1973 | Roper | 29/894.323 |
| 3,989,307 | A | | 11/1976 | Reppert | |
| 4,074,599 | A | * | 2/1978 | Allen | 83/346 |
| 4,124,051 | A | | 11/1978 | Horton | |
| 4,181,365 | A | | 1/1980 | Kawaguchi et al. | |
| 4,256,346 | A | | 3/1981 | Kawaguchi et al. | |
| 4,408,379 | A | * | 10/1983 | Kusano et al. | 29/894.353 |
| 4,897,909 | A | | 2/1990 | LaVoy | |
| 5,188,429 | A | | 2/1993 | Heck et al. | |
| 5,360,261 | A | | 11/1994 | Archibald et al. | |
| 5,533,261 | A | | 7/1996 | Kemmerer | |
| 5,544,945 | A | | 8/1996 | Daudi | |
| 5,568,745 | A | | 10/1996 | Daudi | |
| 5,832,608 | A | * | 11/1998 | Pollkotter | 29/894.324 |
| 5,899,537 | A | | 5/1999 | Abe et al. | |
| 5,899,538 | A | | 5/1999 | Tatraux-Paro et al. | |
| 6,042,194 | A | | 3/2000 | Fitz et al. | |
| 6,244,669 | B1 | | 6/2001 | Braunschweiler | |
| 6,779,852 | B2 | | 8/2004 | Van Houten et al. | |
| 6,785,962 | B2 | * | 9/2004 | Coleman | 29/894.325 |
| 2003/0178887 | A1 | | 9/2003 | de A. Sereno | |
| 2004/0227392 | A1 | | 11/2004 | Coleman et al. | |
| 2008/0034587 | A1 | * | 2/2008 | McCorry et al. | 29/894.323 |

FOREIGN PATENT DOCUMENTS

| | | | |
|---|---|---|---|
| DE | 26 39 483 | | 3/1978 |
| EP | 1 262 333 | B1 | 12/2002 |
| FR | 891.283 | | 3/1944 |
| JP | 56-43001 | A | 4/1981 |
| JP | 57-70089 | | 4/1982 |
| JP | 60-124501 | | 7/1985 |
| JP | 62-34801 | | 2/1987 |

OTHER PUBLICATIONS

1988 Bead-Seat Attached Vehicle Wheel.
1994 Well-Attached Vehicle Wheel Photo # 1.
1994 Well-Attached Vehicle Wheel Photo #2.
1986 Well-Attached Vehicle Wheel.
Motor Wheel Corporation Drawing L-36273, Feb. 24, 1967, Wheel Assem.~14X6JK~5" B.C.~5—Holes.
Motor Wheel Corporation Ddrawing L-36274, Feb. 24, 1967, DISC~14" Dia. 5" B.C.~5—Holes.
US 6,755,485, 06/2004, Chase (withdrawn)

* cited by examiner

METHOD FOR PRODUCING A WHEEL DISC

CROSS REFERENCE TO RELATED APPLICATIONS

The present application is related to co-pending U.S. application Ser. No. 10/836,828 and co-pending U.S. application Ser. No. 11/344,621.

BACKGROUND OF THE INVENTION

The present invention relates to vehicle wheels and, more specifically, to an improved method for producing a wheel disc adapted for use in such a vehicle wheel.

One type of conventional fabricated vehicle wheel comprises a two-piece construction having an inner disc and an outer rim. The disc includes an inner wheel mounting portion and an outer annular portion. The wheel mounting portion defines an inboard mounting surface and includes a center pilot or hub hole, and a plurality of lug receiving holes formed therethrough for mounting the wheel to an axle of the vehicle. The rim is fabricated from steel, aluminum, or other alloys, and includes an inboard tire bead seat retaining flange, an inboard tire bead seat, an axially extending well, an outboard tire bead seat, and an outboard tire bead seat retaining flange. The outer annular portion of the disc is typically secured to the inner radial surface of the rim by welding.

Some preferred materials for the disc are steel and other alloys which can be cold worked from a flat blank into the desired final shape of the disc. Using several stages of die stamping and punching, a wheel disc of sufficient dimensional accuracy and strength can be economically produced. An example of progressive die stamping to manufacture wheels discs with multi-stage, high speed transfer press equipment is shown in U.S. Pat. No. 5,568,745, issued to Daudi on Oct. 29, 1996, which is incorporated herein by reference in entirety.

In addition to stringent requirements for strength and shape of both the wheel disc and rim, an attractive styling of the wheel disc is desired. Windows are formed in a typical wheel disc in order to give the wheel a spoked appearance by forming a single spoke between each pair of adjacent windows. The windows also function to provide a flow of cooling air to brake units installed inboard of the wheel.

To further improve styling of a stamped wheel disc, cladding of various shapes and finishes may be applied to the outboard side of the wheel disc after it is assembled to the rim. The cladding shape may conform to the shape of the wheel disc or it may provide a very different appearance. Regardless of actual styling, it is preferable that enough "see-through" area remains after installing the cladding to allow sufficient air flow to cool the wheel and brake.

Recent trends in wheel styling have made it desirable to provide large windows so that the unitary spokes between windows are as small as possible.

When a cladding is used, a large window size in the wheel disc provides greater flexibility in styling the cladding such that the cladding windows can be located in more arbitrary locations.

Using conventional techniques for fabricating stamped wheel discs from flat blanks, it has not been possible to obtain larger window sizes. During manufacture, the blank is typically bent over to form the outer band prior to punching the windows because if the windows were to be punched first then they would distort to an unacceptable degree during bending. With larger window sizes, a punching operation becomes increasingly difficult because of the need to provide the space to receive the slugs as they are punched out.

In order to obtain larger window sizes, other forming processes such as casting have been employed. However, these other processes and materials are less well suited to low cost, mass production. Therefore, it would be desirable to obtain increase window sizes with a stamped wheel disc.

SUMMARY OF THE INVENTION

The present invention provides an improved wheel disc forming process that enables an increased window size. An intermediate camming operation performs a preliminary shaping prior to final shaping with a wipe die so that the disc may be formed without introducing stresses that would weaken the disc or distorting the window shape.

In one aspect of the invention, a method is provided for forming a wheel disc. A plurality of windows are formed in the wheel disc, wherein each window has a respective outer edge proximate with a continuous outer band around a periphery of the wheel disc. The windows define a plurality of spokes between adjacent windows, and the angular size of each of the windows along the outer band is preferably greater than the angular size of each of the spokes. The outer band is partially closed toward a cylindrical shape by engaging a cam die against at least a portion of the outer band. The outer band is substantially fully closed into a cylindrical shape by axially wiping the outer band using a cylindrical die.

Other advantages of this invention will become apparent to those skilled in the art from the following detailed description of the invention, when read in light of the accompanying drawings.

DETAILED DESCRIPTION OF THE INVENTION

Figure 2:
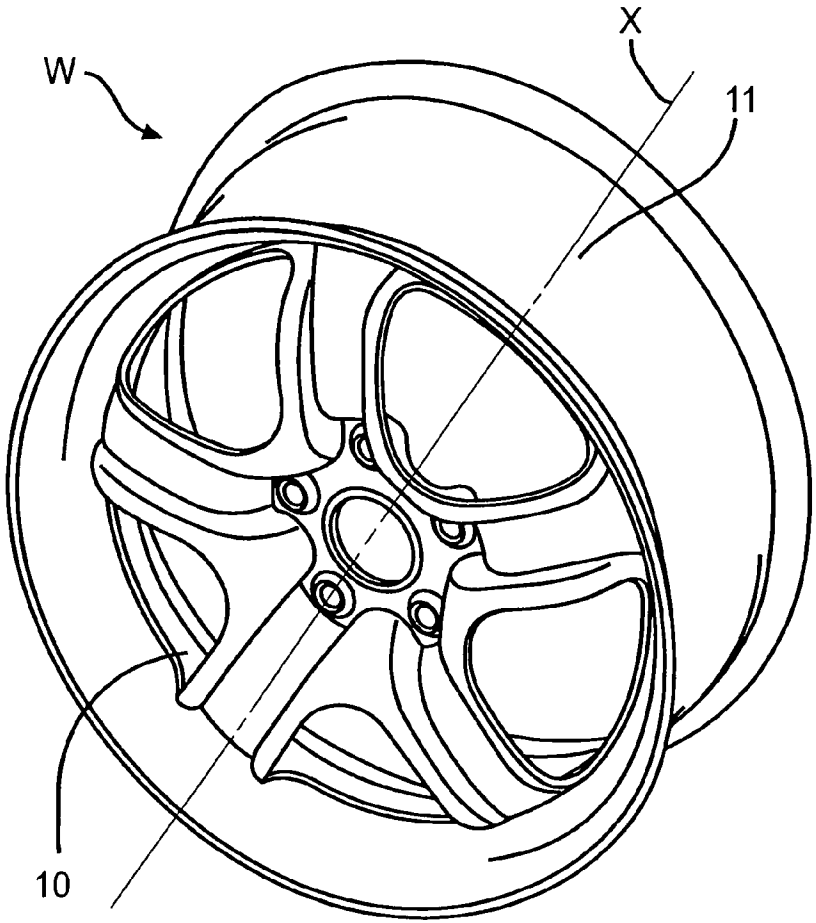
FIG. 2 is a perspective view of the wheel disc of FIG. 1 joined with a wheel rim.
Figure 1:
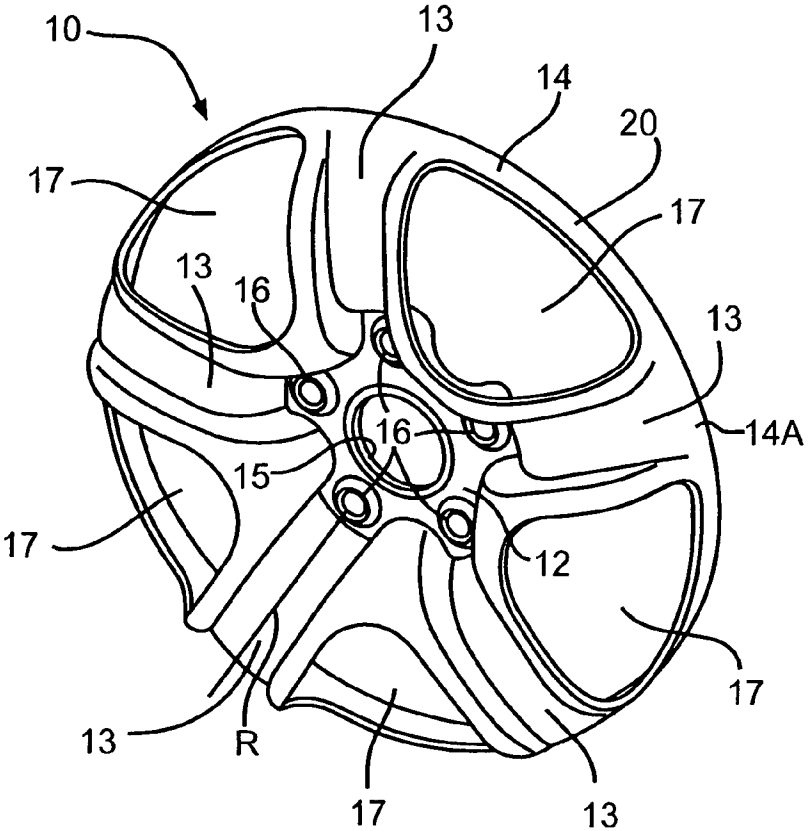
FIG. 1 is a perspective view of a wheel disc fabricated according to an embodiment of the present invention.

Referring to FIG. 1, a wheel disc 10 having the shape shown is to be made from flat stock using cold stamping. After it is made, disc 10 may be welded, riveted or otherwise suitably secured to a suitable rim 11, as shown in FIG. 2, to produce a wheel W having a wheel or wheel disc axis X. Wheel rim 11 is fabricated or otherwise formed from a suitable material, such as for example, steel, aluminum or alloys thereof, magnesium, or titanium.

Wheel disc 10 is fabricated or otherwise formed from a suitable material having the ductility necessary for cold working, such as for example, steel, aluminum or alloys thereof, steel, magnesium, or titanium. Wheel disc 10 includes a generally centrally located wheel mounting surface or contour 12, a plurality of outwardly extending unitary spokes 13, and an outer annular rim connecting band or flange 14. In the illustrated embodiment, disc 10 includes five of such unitary spokes 13 which are integral with the wheel mounting surface 12 and outer band 14. In the illustrated embodiment, the spokes are formed as solid spokes; however, one or more of the spokes 13 can have an opening(s) (not shown) formed therein if so desired. Also, as shown in the embodiment illustrated in FIG. 1, each spoke 13 defines a radial line R intersecting the wheel disc axis X and each spoke 13 is preferably symmetrical with respect to the radial line R. Alternatively, a different number, orientation and/or shape of spokes 13 can be employed if so desired.

Wheel mounting surface 12 is provided with a centrally located pilot aperture 15 and a plurality of lug bolt receiving holes 16 circumferentially spaced around pilot aperture 15. Lug bolt receiving holes 16 receive lug bolts (not shown) for securing the finished wheel on an axle of a vehicle.

Wheel disc 10 also includes a plurality of openings or windows 17 formed between adjacent spokes 13. As shown in the embodiment illustrated in FIGS. 1 and 2, the angular extent of windows 17 is preferably greater than the angular extent of unitary spokes 13, in particular at the outer radial periphery of disc 10 proximate to outer band 14. Alternatively, the angular extent of the windows 17 relative to the spokes 13 can be other than illustrated if so desired.

Outer band 14 extends in a generally axial direction and is joined to the remainder of disc 10 only by spokes 13. Consequently, the transitions between each spoke 13 and outer band 14 should be formed without fractures, cracks, or other imperfections that could weaken the structural integrity of the disc 10 and therefore the wheel. Since outer band 14 defines an annular mounting flange for welding to rim 11, it is bent down by approximately ninety degrees from the plane of the original blank during the stamping process. As shown in the embodiment illustrated in FIGS. 1 and 2, windows 17 are so large that a side edge surface 20 of windows 17 has its face generally perpendicular to the wheel axis X. In other words, outer band 14 is a generally flat cylinder with substantially no curvature (at least in the area of the circumferential center of each window 17) so as to extend in a generally axial direction and define a side edge surface 14A extending between each pair of adjacent spokes 13 which extends in a generally axial outboard direction. This generally flat cylindrical shape gives the least amount of intrusion of outer band 14 into the view through windows 17 after disc 10 is joined to rim 11 which is desirable for styling purposes. However, the degree of bending and the narrowness of unitary spokes 13 would result in excessive material stress at the transition between spokes 13 and outer band 14 when using prior art stamping processes.

Figure 3:
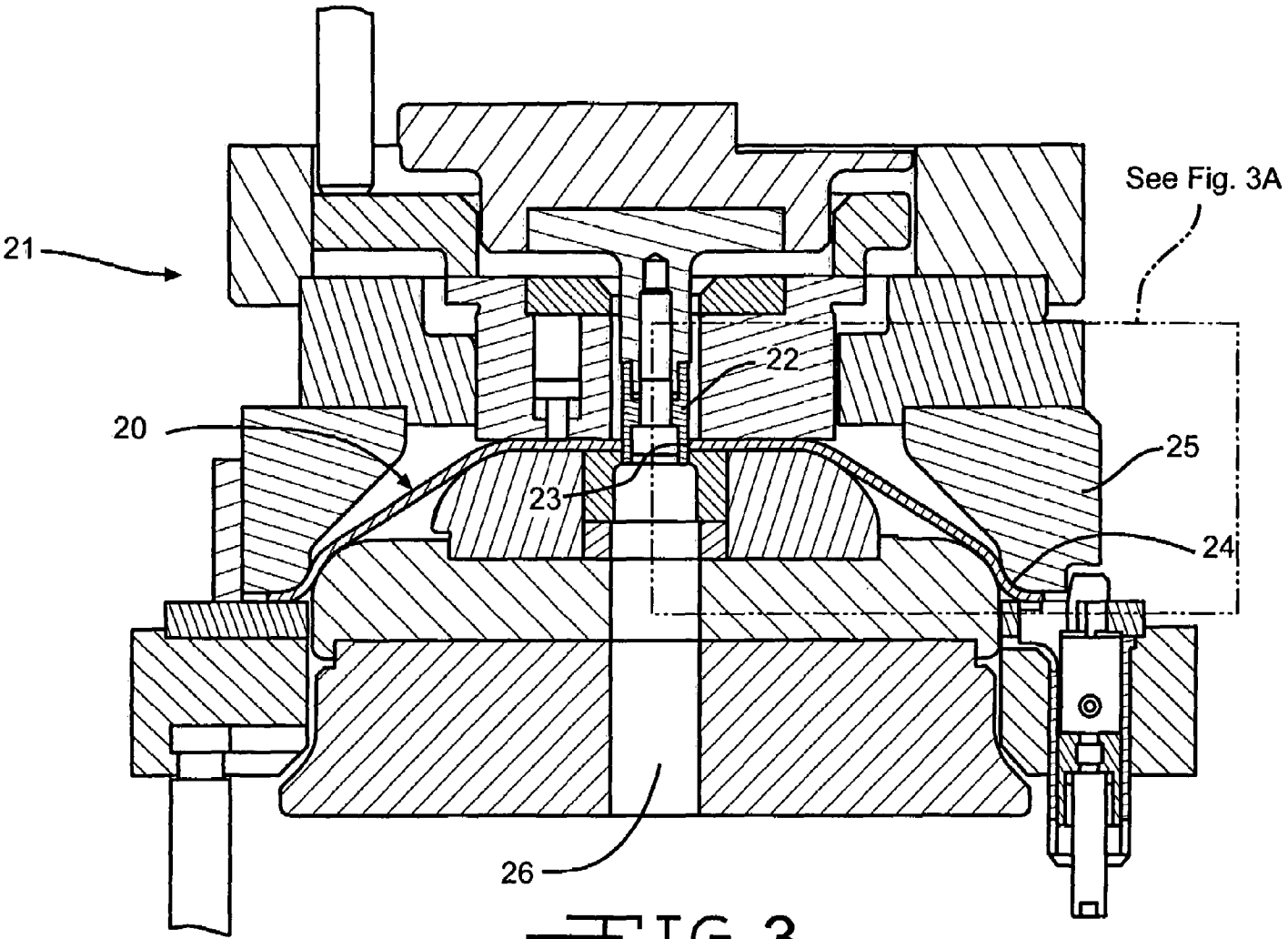
FIGS. 3 and 3A are cross-sectional views of a closed press after processing a wheel disc according to a first operation of a preferred embodiment.
Figure 3A:
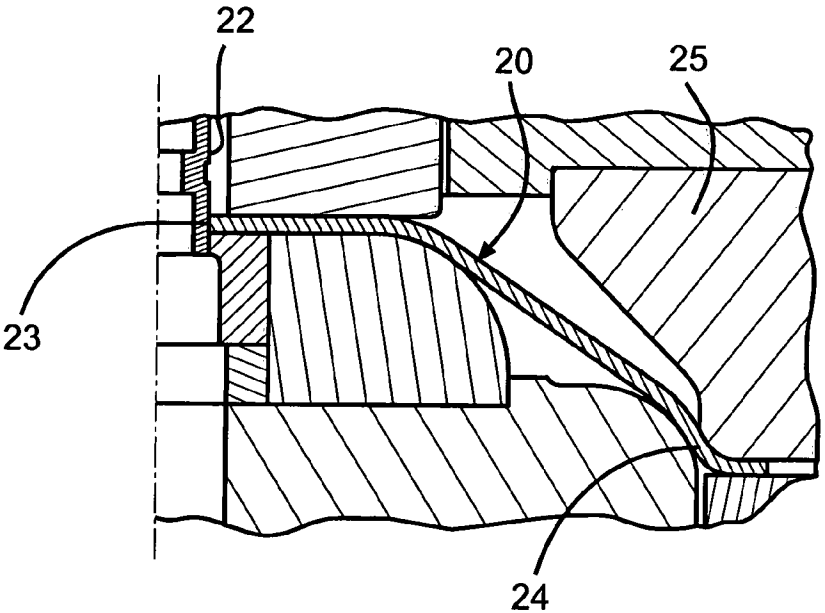

FIGS. 3 and 3A show a tooling set, indicated generally at 21, for performing a first operation on a wheel disc blank (not shown) to produce a wheel disc 20. Tooling set 21 is adapted to be mounted to a punch press (not shown) and performs a metal stamping operation easily appreciated by those skilled in the art from an inspection of FIG. 3. A generally flat circular blank (not shown) is loaded into tooling set 21 and then the press is moved into its closed configuration depicted in FIG. 3. A punch 22 in tooling set 21 punches a preliminary center hole 23 into wheel disc 20 while the outer edges of wheel disc 20 are drawn downward into a generally symmetrical bowl shape. The result of drawing the blank into a bowl shape and piercing a preliminary center hole 23 is to add material volume needed for subsequent drawing steps and work hardening of the material.

To initiate the bending of the outer periphery of wheel disc 20 into an outer band, a ridge may be formed in an outer band forming region 24 of wheel disc 20 by a die 25. Tool set 21 includes a chute 26 for removing the slug punched out from preliminary center hole 23. After completing the first operation shown in FIG. 3, tooling set 21 is opened and wheel disc 20 is transferred to a subsequent press for the next operation.

Figure 4A:
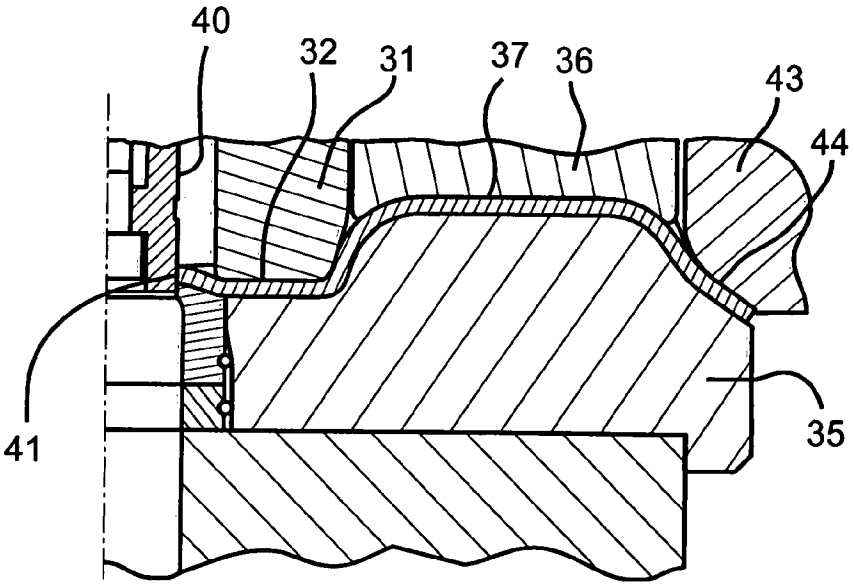
FIGS. 4 and 4A are cross-sectional views of a closed press after processing a wheel disc according to a second operation of a preferred embodiment.
Figure 4:
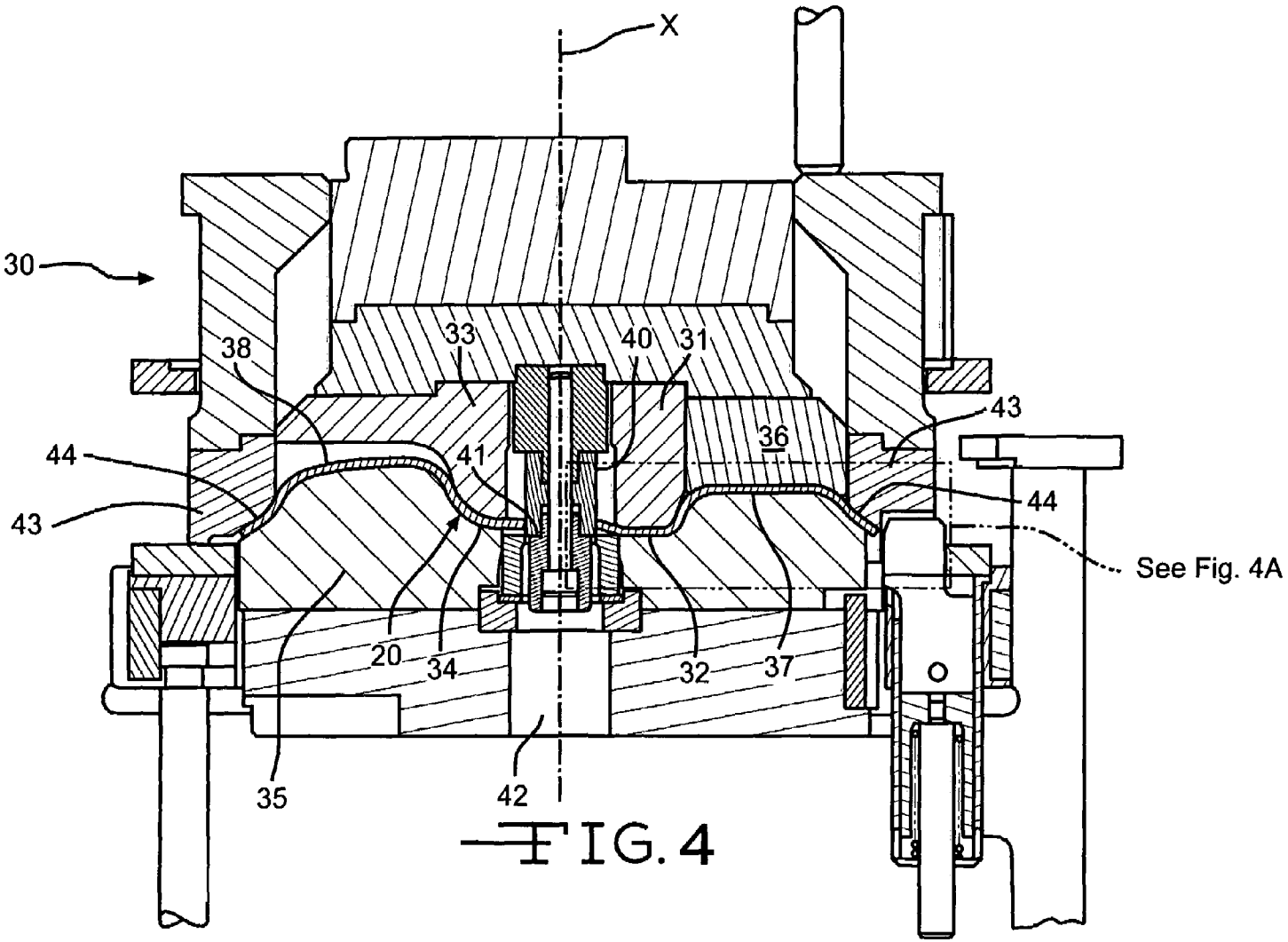

FIGS. 4 and 4A show a second operation wherein a tooling set, indicated generally at 30, performs further preliminary shaping of wheel disc 20. Die details 31 and 33 perform preliminary shaping in inner wheel mounting areas 32 and 34, respectively. In particular, area 32 corresponds to a lug bolt mounting hole region. Die details 35 and 36 cooperate to stamp a spoke-forming region 37 and a window forming region 38. In the embodiment shown in FIGS. 1 and 2, a total of five spoke-forming regions 37 and five window forming regions 38 are formed around the full periphery of wheel disc 20. In the illustrated embodiment, window forming regions 38 are shown with a greater stamped height than spoke forming regions 37, but any other relative heights between the window and spoke forming regions are possible depending upon the desired final shape of the wheel disc. Tooling set 30 also includes a punch 40 for piercing a final center hole 41 in accordance with the amount of disc material to be left behind to form a final hub-mounting/pilot hole. A chute 42 is provided for removing the slugs created during the piercing operation. Although tooling set 30 is shown in cross section, one skilled in the art will appreciate that the die details have a three dimensional shape.

In the illustrated embodiment, tool set 30 may preferably also include die detail 43 having generally sloped edges complementary to sloped portions of die detail 35 for converting the ridge into an angled leg in outer band-forming area 44 of wheel disc 20. Preferably, in the illustrated embodiment, the angled leg in outer band forming region 44 may be oriented at about forty-five degrees or more from the wheel disc axis X (i.e., the central vertical axis through the center of final center hole 41). It is desirable to bend down region 44 no more than about forty-five degrees prior to piercing of the windows. Otherwise, the piercing angle at at least one side of the associated window would be far from perpendicular, resulting in a very sharp edge to the window.

Figure 5:
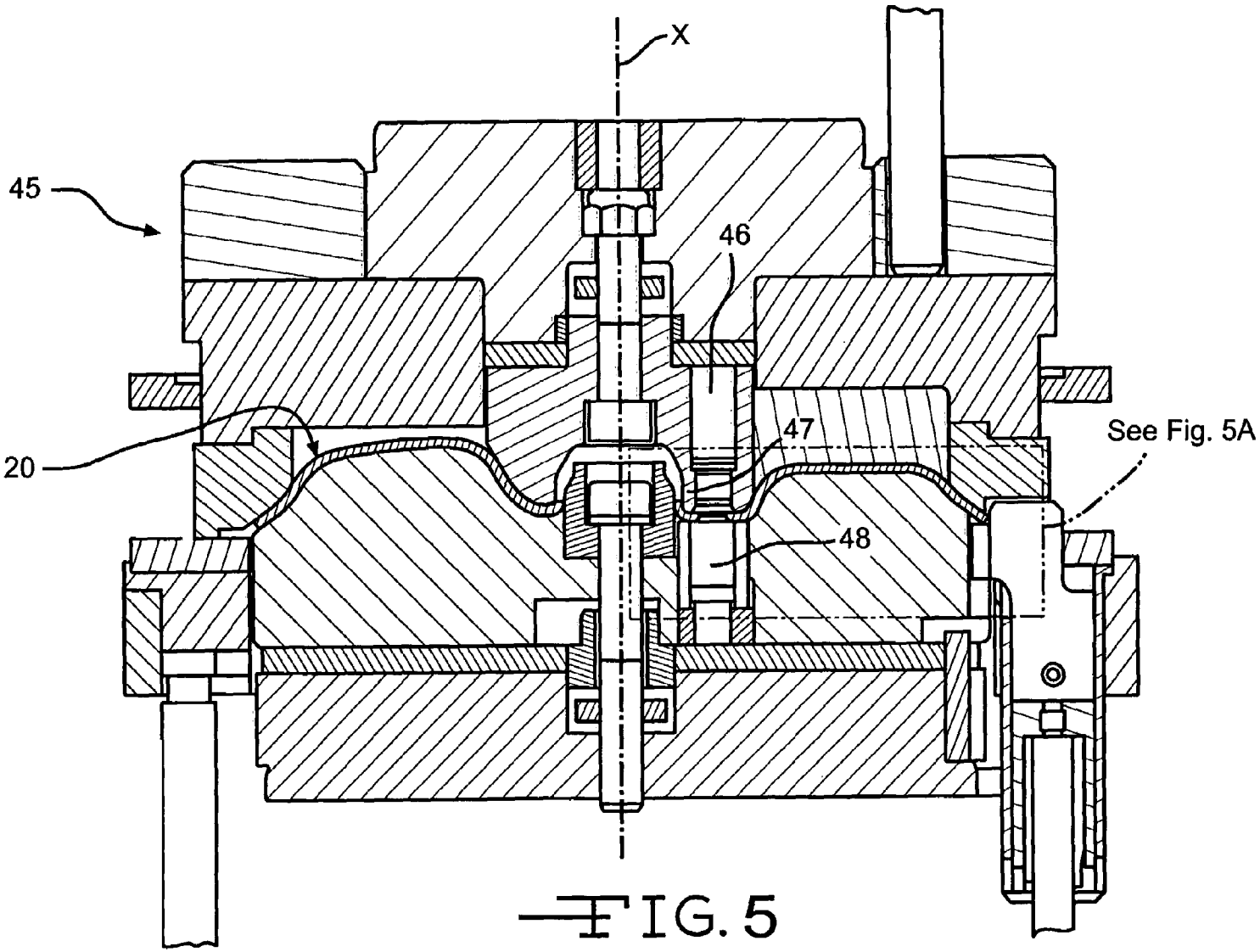
FIGS. 5 and 5A are cross-sectional views of a closed press after processing a wheel disc according to a third operation of a preferred embodiment.
Figure 5A:
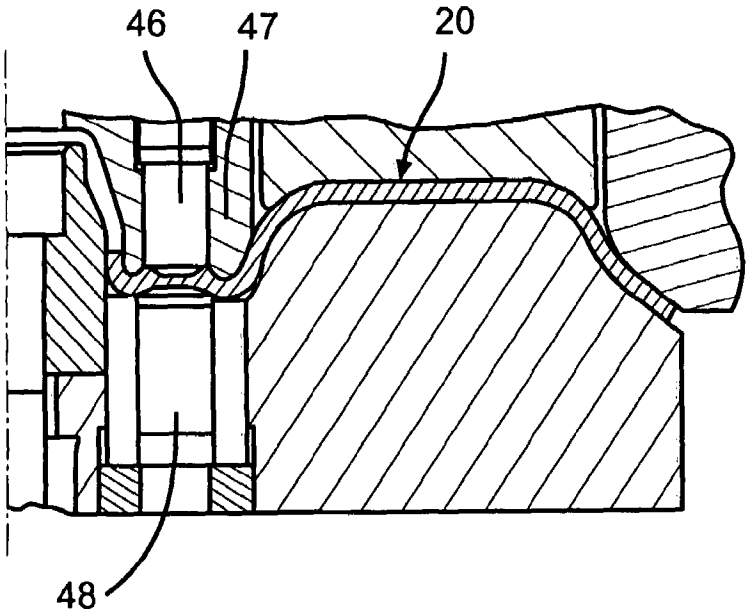

FIGS. 5 and 5A show a tooling set, indicated generally at 45, for a next operation conducted in a subsequent press to which wheel disc 20 is transferred. This operation draws a lug bolt mounting hole shape at specific bolt hole positions in the bolt forming region around the center hole. Thus, wheel disc 20 is pressed between upper die details 46 and 47 and lower die detail 48 to redistribute the material volume around the position for the final lug bolt mounting holes. Minor adjustments in the shaping of the window forming regions and spoke forming regions may also be included in this operation.

Figure 6A:
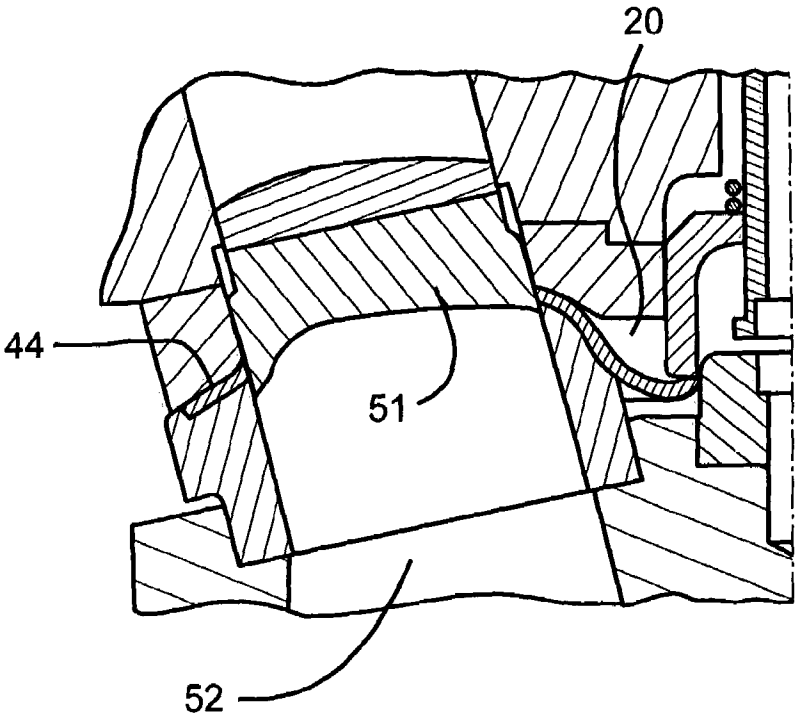
FIGS. 6 and 6A are cross-sectional views of a closed press after processing a wheel disc according to a fourth operation of a preferred embodiment.
Figure 6:
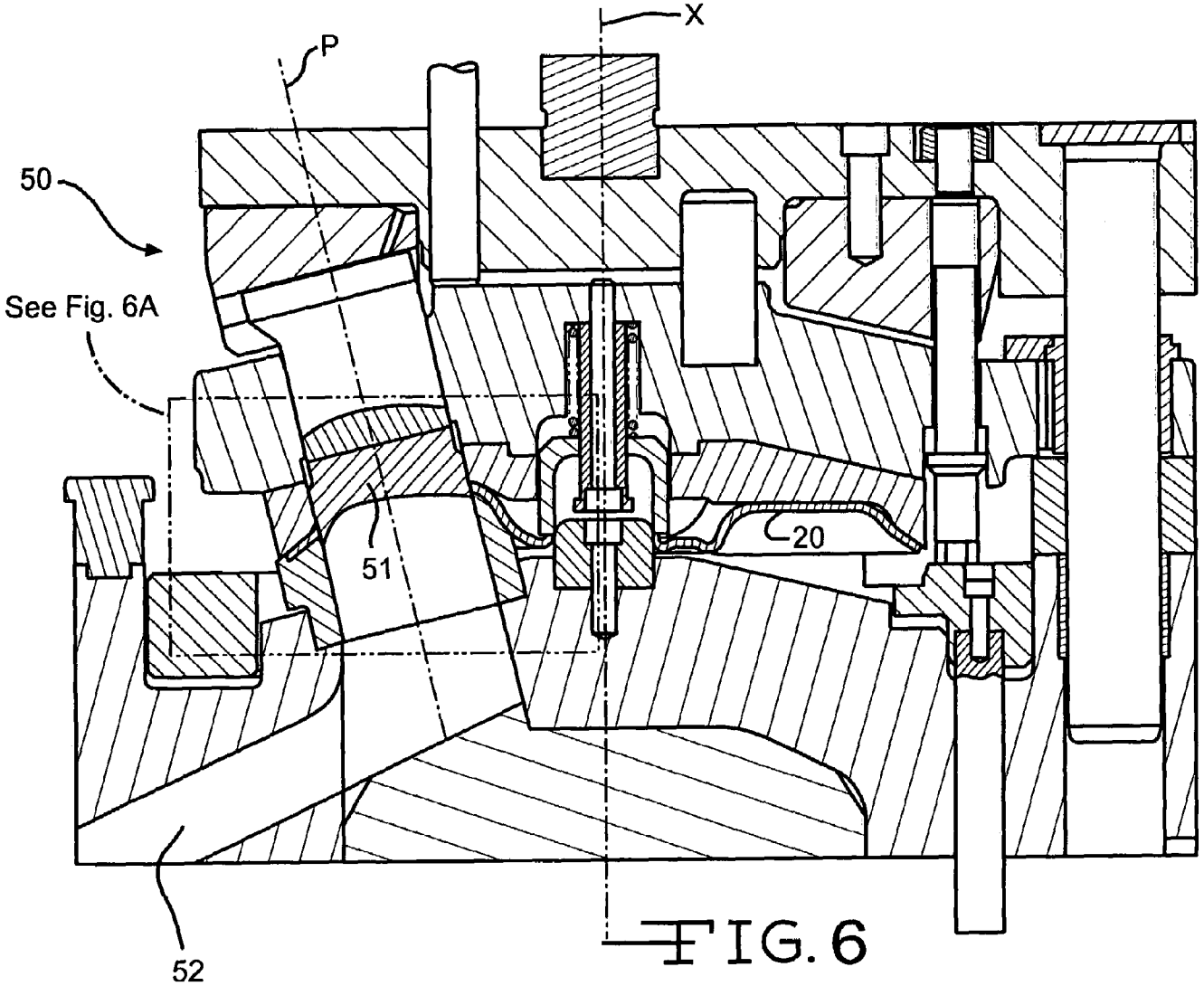

The next operation is shown in FIGS. 6 and 6A and includes piercing of the windows using a tooling set, indicated generally at 50. A punch detail 51 is driven into the window forming regions of wheel disc 20 to produce windows in the disc and the resulting slug is removed through a chute 52.

In the illustrated embodiment, punch detail 51 is preferably operated along a punch axis P which is inclined to the wheel disc axis X. This helps ensure straight, nearly perpendicular edges are formed along the periphery of each window being pierced. More specifically, the punch axis P may be inclined to the wheel disc axis X by less than about twenty degrees and most preferably by an angle of about ten degrees. Other inclination angles may be appropriate depending upon the orientation of the surface being pierced.

Figure 7:
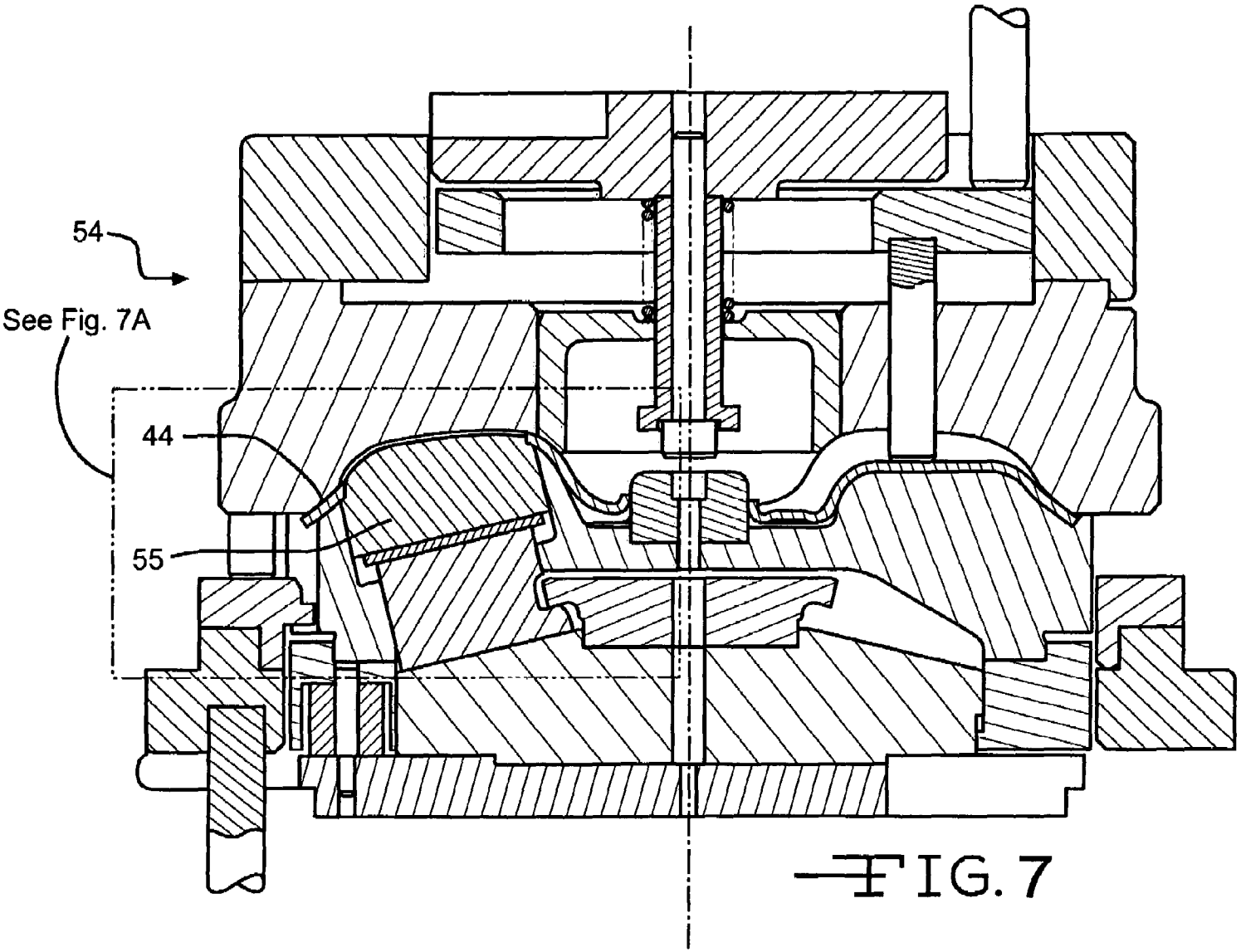
FIGS. 7 and 7A are cross-sectional views of a closed press after processing a wheel disc according to a fifth operation of a preferred embodiment.
Figure 7A:
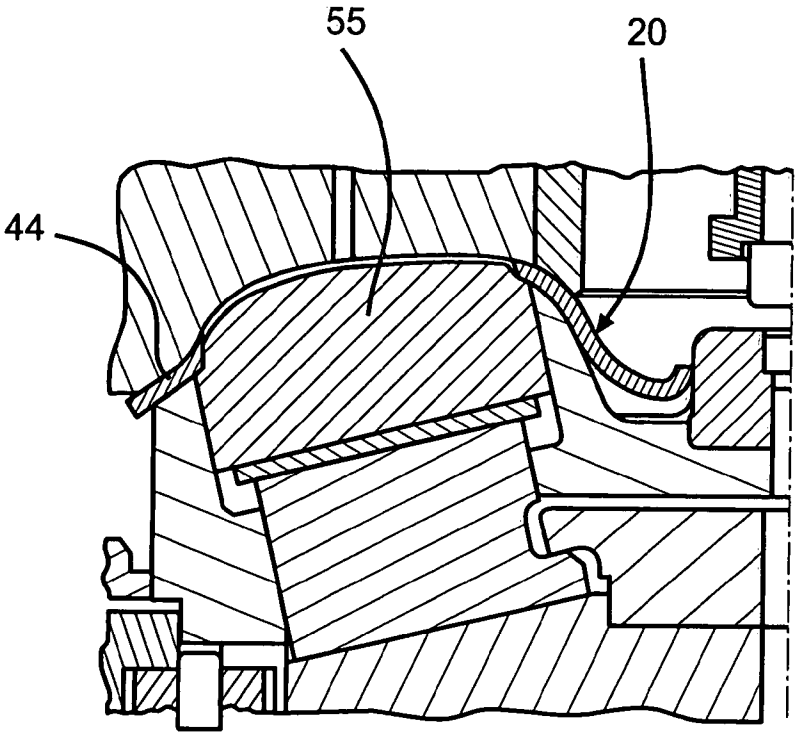

In the subsequent operation shown in FIGS. 7 and 7A, the window holes are coined using a tooling set, indicated generally at 54. Specifically, a die detail 55 impacts the periphery of the windows to coin the edge thereof.

Figure 8A:
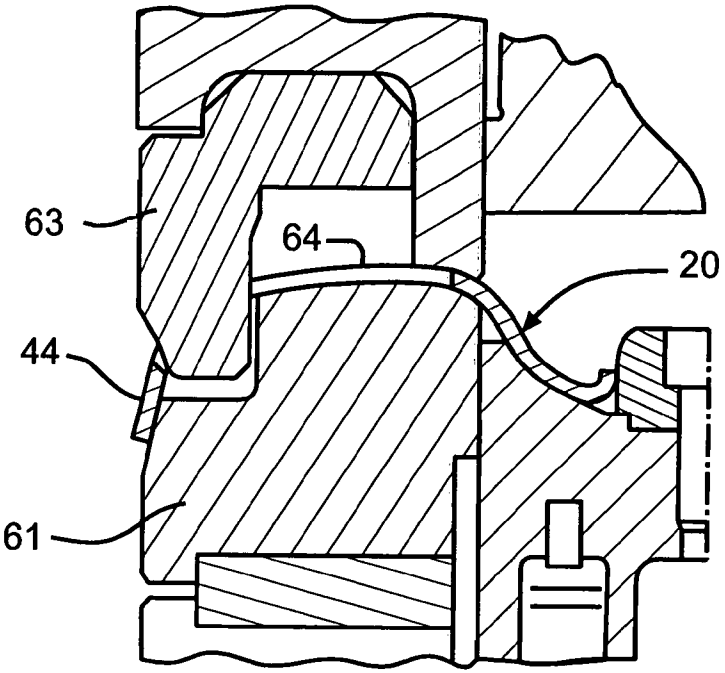
FIGS. 8 and 8A are cross-sectional views of a closed press after processing a wheel disc according to a sixth operation of a preferred embodiment.
Figure 8:
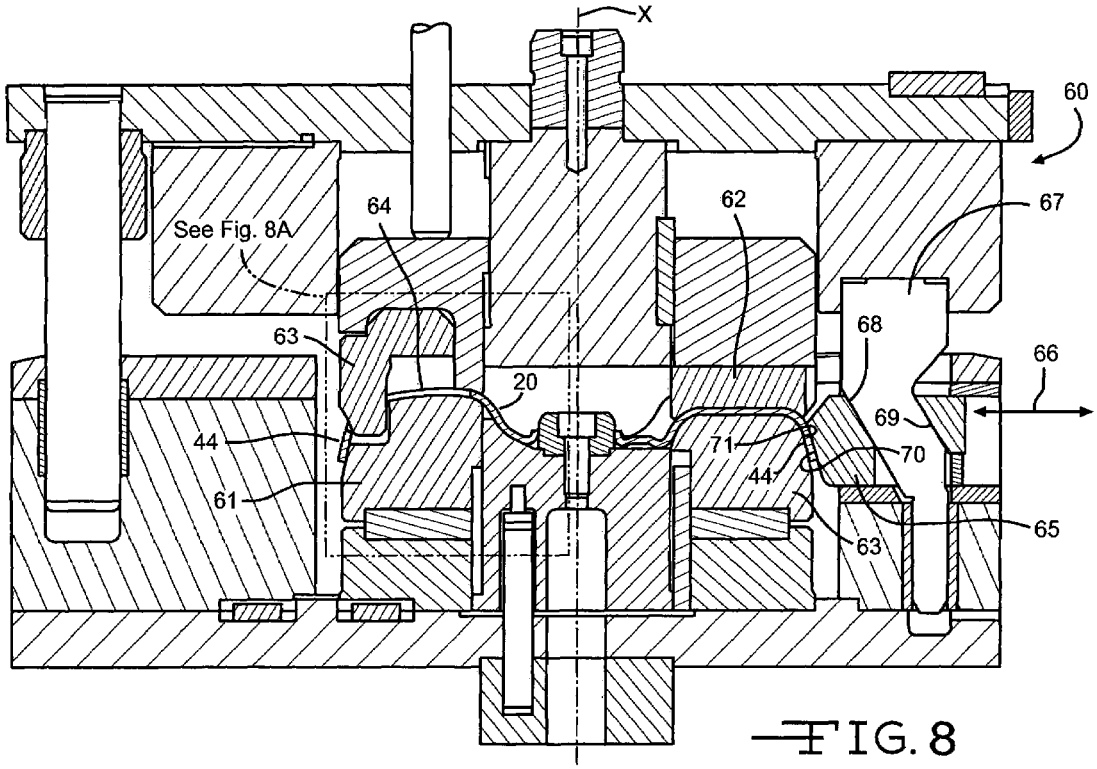

The next operation shown in FIGS. 8 and 8A partially closes the outer band using a tooling set, indicated generally at 60. Tooling set 60 is shown in its closed configuration holding wheel disc 20 in position to allow outer band-forming region 44 to be bent to a more nearly cylindrical shape. Thus, wheel disc 20 may be held in place between die details 61 and 62 in a location registered by a locating finger 63 passing through a window 64. A radial cam die detail 65 is shown at its radially inward position after having driven outer band forming area 44 radially inward to partially close it.

Die detail 65 can be driven in a reciprocating manner in the direction of arrows 66 by upward and downward movement of a cam driver 67. Driver 67 has a slanted portion 68 for engaging a cam follower slot 69 in die detail 65. An angled surface 70 of cam die detail 65 bends outer band forming region 44 downward as cam die detail 65 moves radially inward until region 44 engages a sloped surface 71 of die detail 61. Thus, outer band-forming region 44 at the transition areas to the spoke forming regions is bent to nearly its final curvature without actual drawing or reshaping that would apply stress to the areas that could otherwise lead to fractures or thinning.

Preferably, the cam die detail 65 comprises separate circumferential cam sections spaced around the periphery of tooling set 60 for simultaneously camming respective portions of outer band forming region 44. The separate cam sections account for the reduced circumference at a smaller radius. Small gaps between the separate cam sections may be about one quarter of an inch at the smaller radius. The gaps may preferably be located corresponding to points on the perimeter away from the spokes (i.e., juxtaposed with the windows) since no significant bending is needed there. After camming over outer band forming region 44, driver 67 is moved upward to withdraw cam die detail 65 to its radial outward position and wheel disc 20 may be transferred to the next operation.

Figure 9:
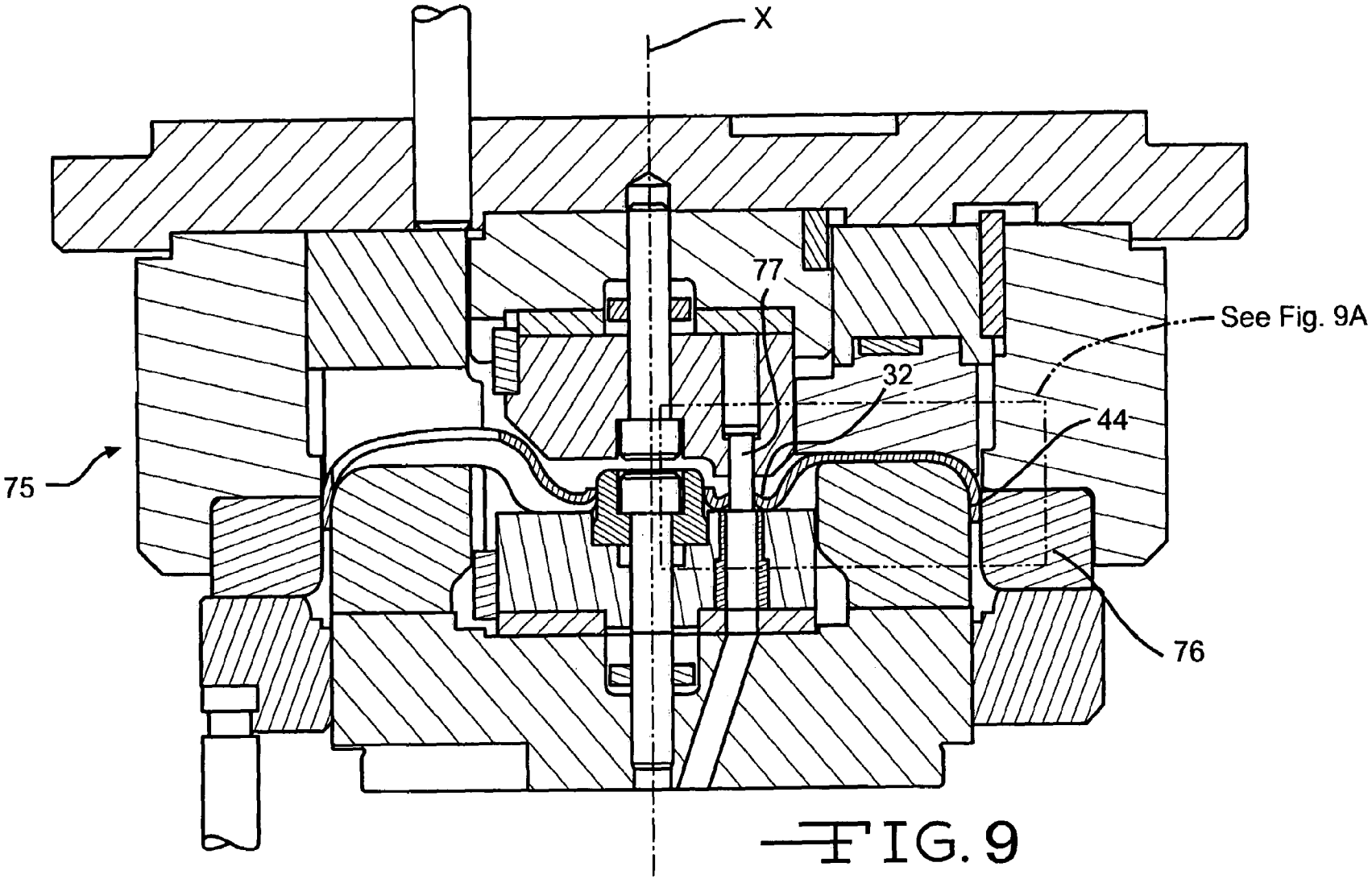
FIGS. 9 and 9A are cross-sectional views of a closed press after processing a wheel disc according to a seventh operation of a preferred embodiment.
Figure 9A:
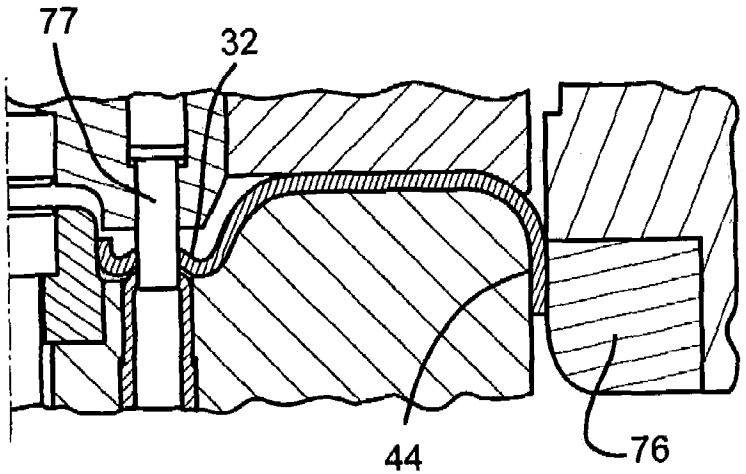

FIGS. 9 and 9A show a tooling set, indicated generally at 75, for fully closing the outer band into an annular or cylindrical flange while simultaneously piercing lug bolt holes in the bolt forming regions. More specifically, a wipe die detail 76 moves downward to engage region 44 in order to axially wipe the outer band region. The leg of outer band forming region 44 is drawn down to an approximately ninety degree angle from its original horizontal orientation so that an annular or cylindrical surface parallel with the wheel disc axis X is formed for mating with the interior side of the rim during assembly. Punch details 77 (of which only one is shown) simultaneously engages the lug bolt forming region 32 in order to produce the appropriate number and shape of lug bolt mounting holes.

Figure 10A:
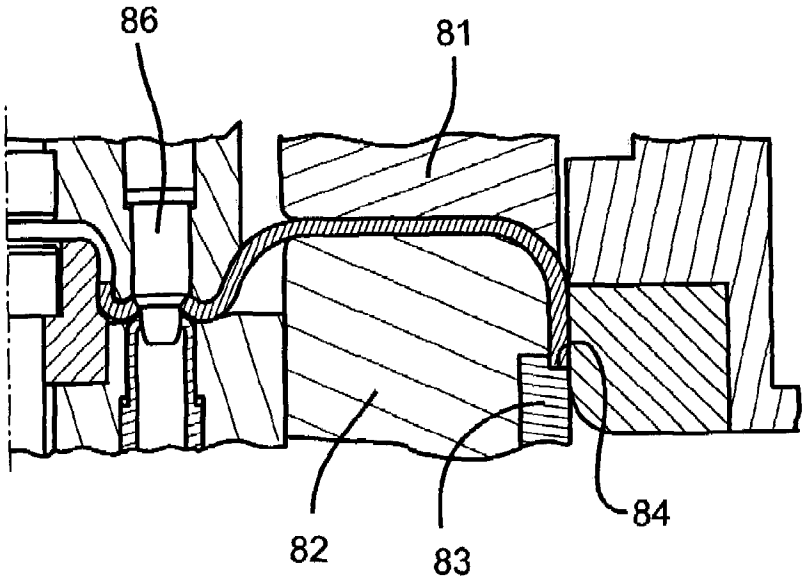
FIGS. 10 and 10A are cross-sectional views of a closed press after processing a wheel disc according to an eighth operation of a preferred embodiment.
Figure 10:
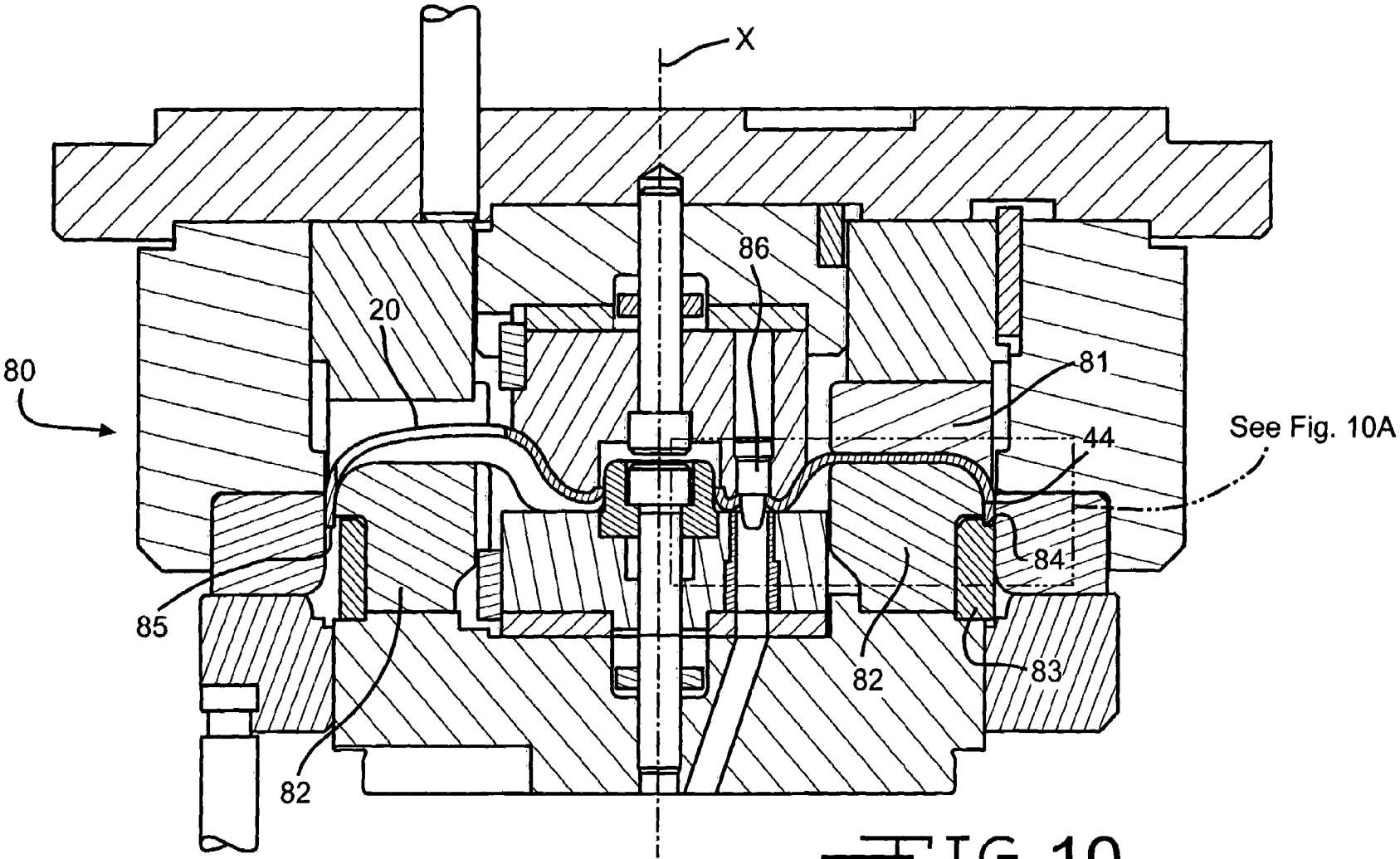

FIGS. 10 and 10A show the next operation wherein the downward extension of outer band 44 is calibrated and the previously pierced lug bolt holes are preliminary coined. Thus, a tooling set, indicated generally at 80, is provided and includes die details 81 and 82 for retaining wheel disc 20 in position while a calibration die detail 83 strikes the peripheral edge of outer band 44 in a direction parallel to the wheel disc axis X. Detail 83 includes a ledge 84 for receiving the peripheral edge of outer band 44. Die detail 83 is segmented around the periphery of tooling set 80 such that one of the gaps between die details 83 is seen on the left side of FIG. 10. Consequently, a portion 85 of outer band 84 is not struck by the die detail 83. However, the gaps between separate circumferential segments around wheel disc 20 are preferably only about one-quarter inch so that full calibration of the outer band is achieved. Simultaneously with the outer band axial calibration, a final coining may be performed of the lug bolt holes using a coining die detail 86.

Figure 11:
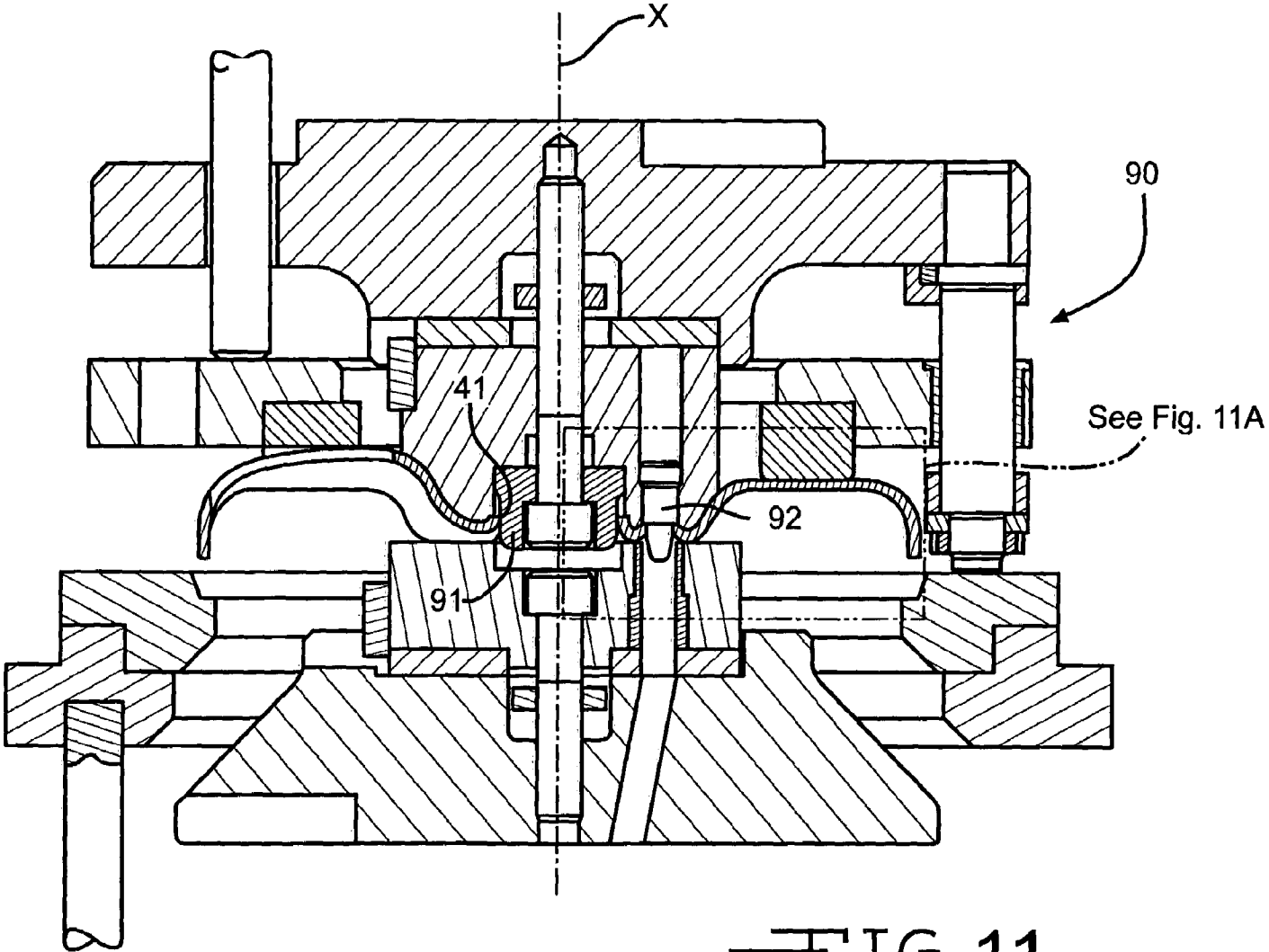
FIGS. 11 and 11A are cross-sectional views of a closed press after processing a wheel disc according to a ninth operation of a preferred embodiment.
Figure 11A:
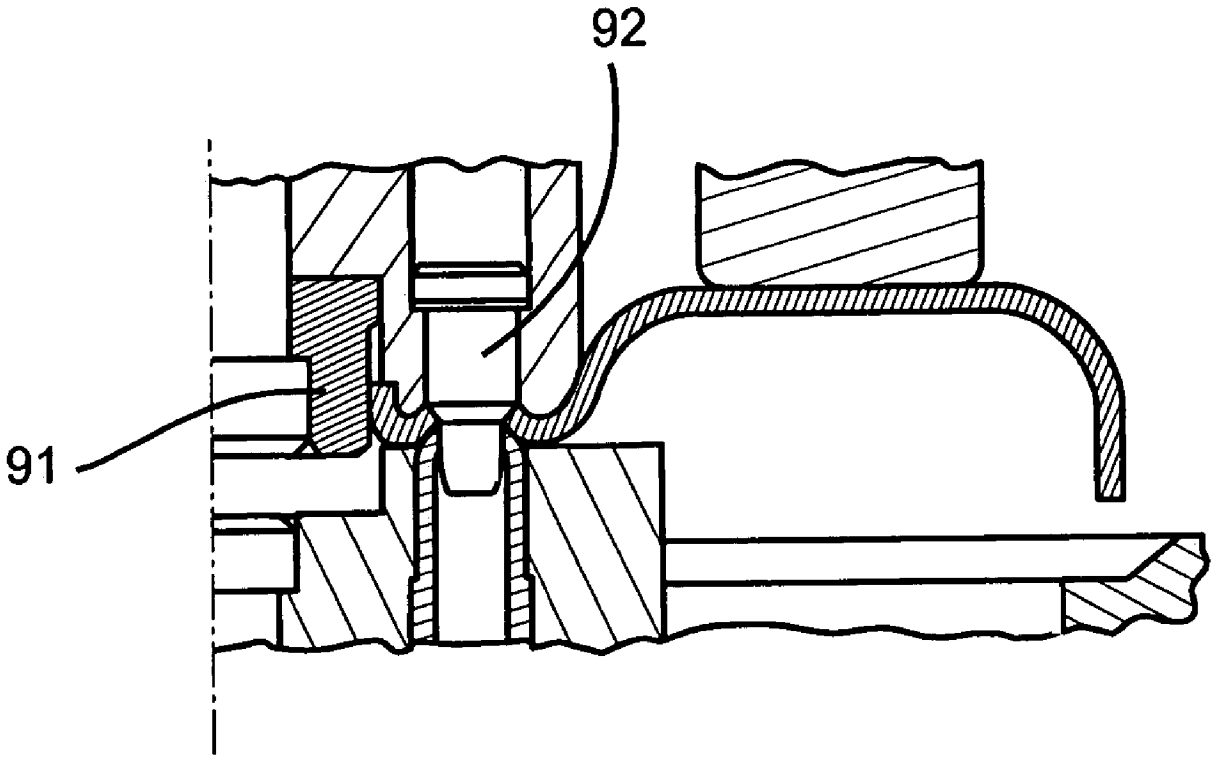

A final operation in the preferred embodiment is shown in FIGS. 11 and 11A wherein the diameter of the center hole is calibrated while coining the lug bolt holes a second time. Thus, a tooling set, indicated generally at 90, is provided and includes a calibrating die detail 91, which is driven into the center hole 41, and a coining detail 92, which is driven against the lug bolt forming regions.

In view of the foregoing description, a stamping or metal forming process has been shown wherein relatively large windows can be formed in a wheel disc. A cylindrical flange for attaching the wheel disc to a rim is obtained without introducing flaws in the transition areas between the spokes and the outer band by virtue of an intermediate camming operation before wiping the outer band into its desired final cylindrical shape.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A method of forming a wheel disc comprising the steps of:

forming a flat disc blank into a bowl shape wheel disc and forming a center hole;

forming the bowl shaped wheel disc to form spoke forming regions adjacent window forming regions;

forming a plurality of lug bolt hole regions around the center hole and flanging the center hole;

forming a plurality of windows in respective window forming regions of the wheel disc, wherein each window has a respective outer edge proximate with a continuous outer band around a periphery of the wheel disc, wherein the windows define a plurality of spokes in the spoke forming regions between adjacent windows, and wherein an angular size of each of the windows along the outer band is preferably greater than an angular size of each of the spokes;

coining the plurality of windows;

partially closing the outer band toward a cylindrical shape by engaging a cam die against at least a portion of the outer band;

fully closing the outer band substantially into a cylindrical shape by wiping the outer band using a cylindrical die and piercing bolt holes in the bolt hole regions; and calibrating a peripheral edge of the outer band by striking the peripheral edge with a ledge advancing generally parallel to a wheel disc axis and coining the bolt holes.

2. The method of claim 1, further comprising the step, after said axial calibrating step, of:

calibrating a diameter of the center hole and coining the lug bolt holes.

3. The method of claim 1, wherein a preliminary center hole is formed while forming the flat disc blank into the bowl shaped wheel disc, the method further comprising:

forming a final center hole while forming the bowl shaped wheel disc to form the spoke forming regions adjacent the window forming regions.

4. The method of claim 1, wherein the windows are formed in the window forming regions along a punch axis inclined to the wheel disc axis.

5. The method of claim 4, wherein the punch axis is inclined to the wheel disc axis by less than about twenty degrees.

6. The method of claim 4, wherein the punch axis is inclined to the wheel disc axis by about ten degrees.

7. The method of claim 1, wherein the cam die includes a slanted engagement surface for radially driving into the outer band.

8. The method of claim 1, wherein the outer band is oriented by about forty-five degrees or more from the wheel disc axis prior to the partial closing step and is oriented by about twenty degrees or less from the wheel disc axis after the partial closing step.

9. A method of forming a wheel assembly comprising the steps of:

forming a flat disc blank into a bowl shaped wheel disc and forming a center hole;

forming the bowl shaped wheel disc to form spoke forming regions adjacent window forming regions;

forming a plurality of bolt hole regions around the center hole and forming the center hole;

forming a plurality of windows in respective window forming regions of the wheel disc, wherein each window has a respective outer edge proximate with a continuous outer band around a periphery of the wheel disc, wherein the windows define a plurality of spokes in the spoke forming regions between adjacent windows, and wherein an angular size of each of the windows along the outer band is preferably greater than an angular size of each of the spokes;

coining the plurality of windows;

partially closing the outer band toward a cylindrical shape by engaging a cam die radially against at least a portion of the outer band;

fully closing the outer band substantially into a cylindrical shape by wiping the outer band using a cylindrical die while piercing bolt holes in the bolt hole regions;

calibrating a peripheral edge of the outer band by striking the peripheral edge with a ledge advancing generally parallel to a wheel disc axis and coining the bolt holes to produce the wheel disc; and securing the wheel disc to a wheel rim to produce the wheel assembly.

* * * * *